United States Patent [19]

Sweet et al.

[11] 4,265,061

[45] May 5, 1981

[54] BUILDING SYSTEM

[76] Inventors: Barry A. Sweet, Durham Dr., Havelock North; John W. Linnell, 813 A Caroline Rd., Hastings, both of New Zealand

[21] Appl. No.: 973,610

[22] Filed: Dec. 27, 1978

[30] Foreign Application Priority Data

Jan. 10, 1978 [NZ] New Zealand ..... 186187

[51] Int. Cl.[3] ..... E04B 7/02

[52] U.S. Cl. ..... 52/93; 52/199; 52/220

[58] Field of Search ..... 52/90, 92, 93, 94, 95, 52/199, 220

[56] References Cited

U.S. PATENT DOCUMENTS

| | | | |
|---|---|---|---|
| 3,086,323 | 4/1963 | Pine | 52/199 X |
| 3,206,903 | 9/1965 | Johnson | 52/92 |
| 3,285,636 | 11/1966 | Hoyle | 52/93 X |
| 3,474,578 | 10/1969 | Wippermann | 52/92 |
| 3,668,828 | 6/1972 | Nicholas et al. | 52/92 |
| 3,683,569 | 8/1972 | Holm | 52/93 |
| 3,683,785 | 8/1972 | Grange | 52/92 X |
| 3,890,759 | 6/1975 | Selden et al. | 52/220 X |
| 3,962,835 | 6/1976 | Little | 52/220 X |
| 4,015,399 | 4/1977 | Prins | 52/92 |

*Primary Examiner*—J. Karl Bell

*Attorney, Agent, or Firm*—Holman & Stern

[57] ABSTRACT

A timber framed building of components able to be fabricated forming a post and beam structure on a foundation completed with diaphragm sheathing on the outside of the frame, the building including exterior wall posts, rafters and ridge beams of paired timber plates which are connected by metal splicing members. The diaphragm sheathing is provided with a strong back between wall posts which runs substantially horizontally around the exterior walls and is secured to posts and is fixed along its length to the diaphragm sheathing. The system allows for aesthetic, low cost, demountable buildings, to be erected speedily by unskilled labor.

19 Claims, 13 Drawing Figures

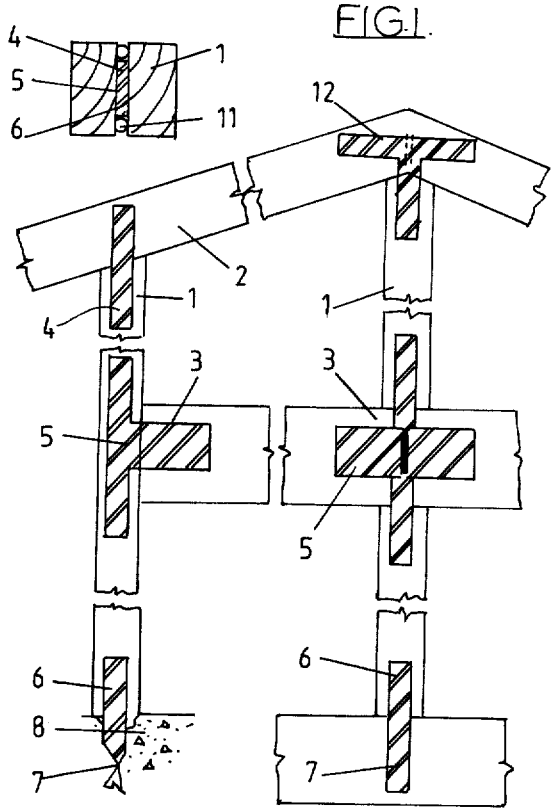
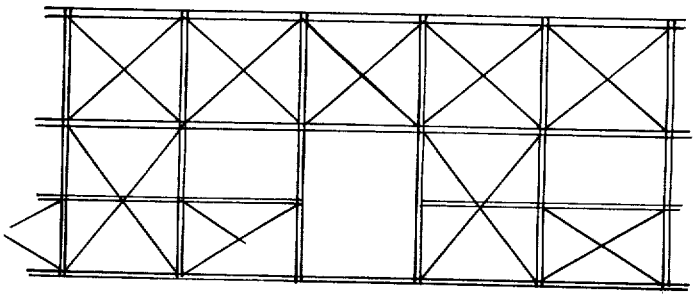
FIG13

FIG 7
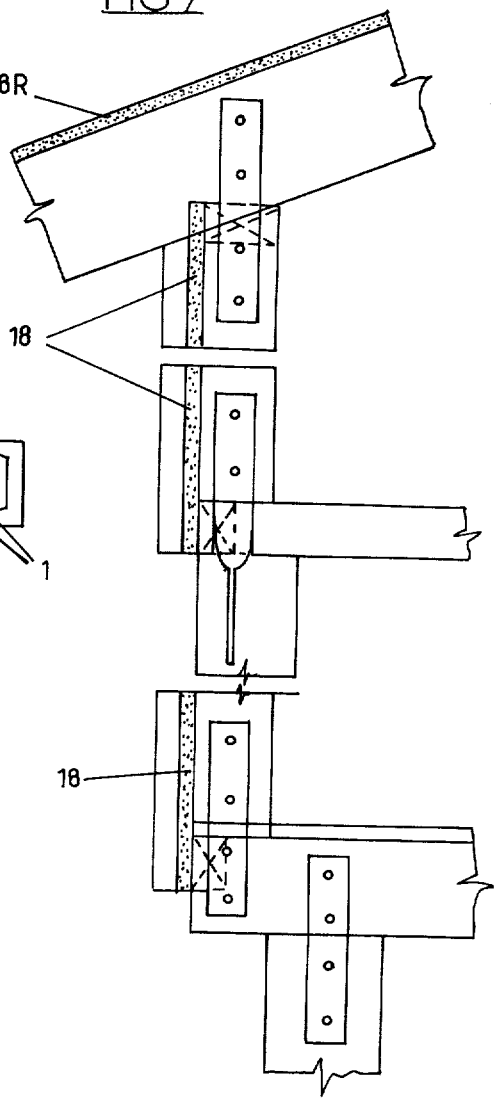
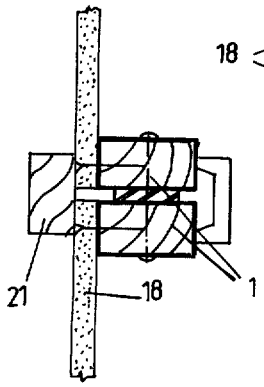
FIG 6.

FIG.11
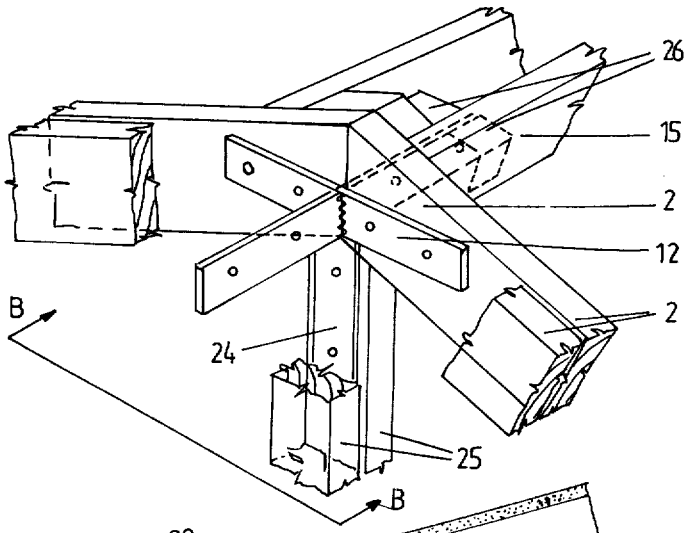
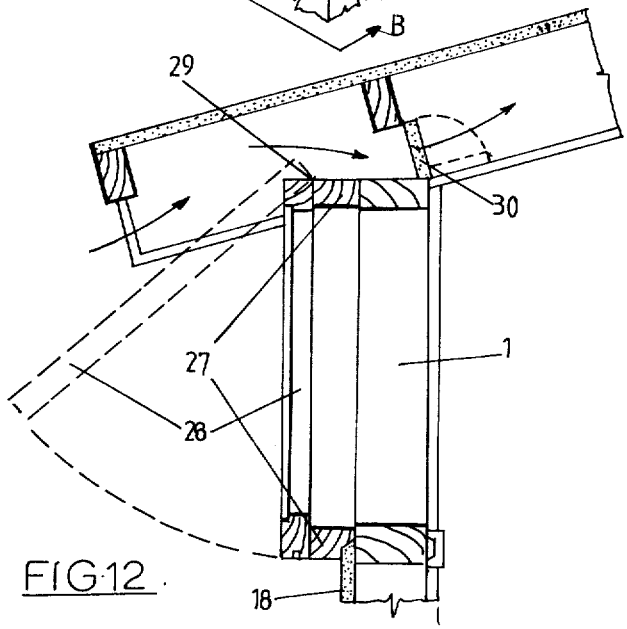
FIG.12

BUILDING SYSTEM

BRIEF SUMMARY OF THE INVENTION

The present invention relates to a timber framed building forming a post and beam structure on a foundation completed with a diaphragm sheathing on the outside of the frame and methods of erection applicable thereto.

Many forms of modular and low cost building are known. Cost savings with such systems are normally in the province of material savings or labour savings. Unfortunately many of the systems when considering their substantial loss of aesthetics do not provide a reduced cost commensurate with the loss of aesthetics and in most cases functionality. Many systems are known which use prefabricated timber components and prefinished panels. Moreover many systems are known which employ the use of metal framed structures. However where one is dealing with largely unskilled labour it is a desire when wishing to tender for a low cost structure to ensure that the same will appeal to the aesthetic sense of the ultimate occupier and can be erected with little difficulty and speedily yet will be fully functional.

The use of stressed skin structures are known to some extent in the building industry. No significant dependence or use of such characteristics however has occured when it comes to the field of low cost prefabricated buildings.

It is therefore an object of the present invention to provide methods and means which will go at least some way to meet the abovementioned desiderata or which will at least provide the public with a useful choice.

The present invention consists in a pre-cut timber framed building which can have been prefabricated or fabricated in part prior to assembly, said building forming a post and beam structure on a foundation and being completed with diaphragm sheathing on the outside of the frame, wherein paired timber plates providing wall posts, rafters and ridge beam(s) of the frame and floor beams if the building is of more than one storey and ridge to floor intermediate posts, if any, are connected (i) foundation to wall posts
(ii) wall posts to floor beams, if any
(iii) wall posts to rafters
(iv) rafters to ridge beam(s)
(v) ridge beam to post, if any
(vi) tie to rafters and/or wall posts, if any, by metal splicing members, and wherein said sheathing is a cladding of both exterior walls and roof with a waterproof, insect resistant, load bearing and structural diaphragm formed from sheet material, there being provided a strong back member between wall posts which runs substantially horizontally around the exterior walls and is secured to wall posts and is fixed along its length to the diaphragm sheet.

Preferably said structure at selected points includes within its frame posts that extend from a ridge beam to the floor level or the foundation of the building. Ideally such a post forms part of an internal partition.

Ideally the metal splicing member that splices said ridge beam to such a ridge post also splices rafters that butt against said ridge beam.

Preferably said building includes a plurality of purlins which extend at right angles to associated rafters. Each purlin is a single timber plate and the same is fixed to the overlying diaphragm cladding. The diaphragm cladding to the roof is also structural particle board.

Preferably said purlins have an upper edge flush with the upper edge of said rafters when taking into account the plane of the sheet cladding material to be affixed thereto.

Preferably said sheathing is not rabbetted into any framing member.

Preferably a window beam is provided between adjacent rafters above any window fitting between adjacent wall posts.

Preferably means are provided to allow controlled ventilation of the building even when the window is in a closed condition.

Preferably utilities selected from wiring and plumbing are passed around or behind the strong back member and is passed between paired timber plates of a framing member.

Preferably an overlying weatherproofing layer on the cladding of the roof is provided. Preferably the structure is demountable.

In a further aspect the invention consists in a method of building a timber framed building in accordance with the present invention which comprises the steps of preparing a foundation, mounting thereon a frame for the building using a paired plate for wall posts, rafter and ridge beams, and also for floor beams if the building is of more than one storey and, ridge to floor intermediate posts, if any, connecting the various framing members using metal splicing members and cladding the frame as it is being erected or after it is erected with a waterproof, insect resistant load bearing, structural diaphragm formed from sheet material, and fixing substantially horizontal around the exterior walls between wall posts to which the same is secured, a strong back member and to the roof framing a similar structural diaphragm material.

In a still further aspect the present invention consists in a method of erecting a building in accordance with the present invention which includes the steps of assembling at least a plurality of prefabricated panels (prefabricated either on site or at a factory remote from the site) with a peripheral single plate framing members on at least one side thereof and bolting the timber plate to a framing member of another prefabricated panel with a peripheral single timber plate framing member and in so doing providing a said paired timber plate framing member.

BRIEF DESCRIPTION OF THE SEVERAL VIEWS OF THE DRAWINGS

One preferred form of the present invention will now be described with reference to the accompanying drawings in which:

FIG. 1 is a cross-sectional view of a paired spaced wall post in accordance with the present invention showing in section diagrammatically a metal splicing member and also showing diagrammatically by means of a circle how utility conduits such as wiring, water and the like, can be passed unobtrusively around the framed structure using such a gap, FIGS. 2 and 3 show some main portal framing members suitable for example for a two storey building showing in dotted outline the positioning of three different types of splicing member (the bottom one not shown completely) capable of holding the various spaced but paired wall posts and beams etc, in a load bearing relationship, FIG. 6 is a plan view of a wall post with the vertically abutted or substantially abutted cladding sheets of the present invention and the exterior substantially vertically weather batten, FIG. 7 is a sectional view of such joints as shown in FIG. 6 taken between paired members, showing splicing members at various junctions, namely post to rafter, post to slab or post to timber sub structure, FIG. 11 is a diagrammatic view of a preferred three-dimensional form of metal splicing member further describing the post, rafter, ridge junction, FIG. 12 is a side elevation diagrammatic view of a joinery unit in accordance with the present invention which has been fixed to the exterior of a building structure in accordance with the present invention and showing with an arrow the position at which a ventilation opening would be provided above the joinery unit and under the weather protection of an eave structure (the same method of face fixing applies to aluminium joiner when chosen to be used), and FIG. 13 is a diagrammatic view showing the flexibility with which joinery or door openings can be provided in a wall formed using the method of the present invention, the diagrams showing a plurality of different configuration bays (i.e. spaces between structural posts or columns) with the cross-sections being the diaphragm bracing sheets.

DETAILED DESCRIPTION OF THE INVENTION

Figure 4:
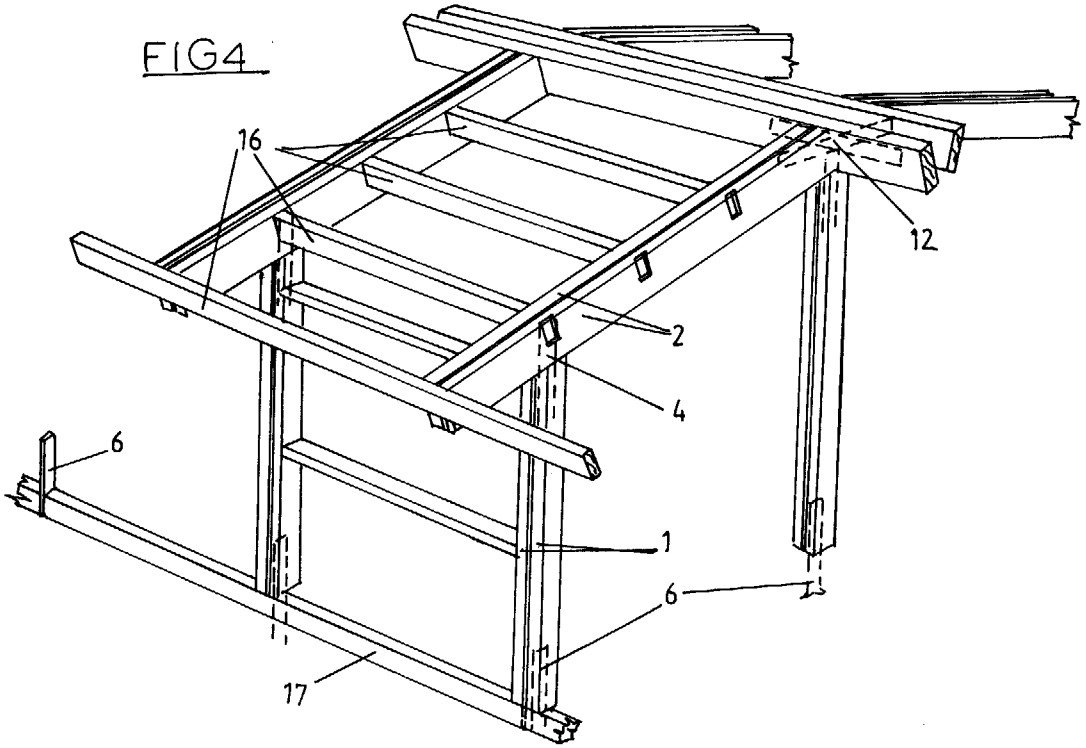
FIG. 4 is a perspective view of the assembled paired timber plate framing members and purlins without cladding.

Several features are of note when considering the technology involved with the building system in accordance with the present invention. The first is the low material cost, i.e. there is a single sheet of cladding material to give an exterior and interior finish, this structural sheathing member being capable of bracing the structure. Preferably it is formed from a particle board having the required properties. Such a suitable structural particle board includes a board FINABOND (a trade name of Henderson & Polland Industries Ltd. of P.O. 8551, Symonds Street, Auckland, New Zealand), and STRUCTEX (a trade name of The Fletcher Timber Co. Ltd. of Fletcher House, 810 Great South Road, Penrose, Auckland 6, New Zealand).

Ideally for cladding walls, 18 mm thickness structural particle board is chosen, and for sheathing the roof framing to provide the finished ceiling 12 mm thick structural particle board is used. Ideally, the size of the sheets is modulated, so that job measurements are kept to an absolute minimum. In other forms of the present invention however, suitable plyboards or the like which have the required structural properties may be substituted if economically worthwhile.

The single thickness cladding of the building finds great advantage in climates such as that encountered in the Tropics and Sub Tropics. In New Zealand, however, with the growing trend towards energy conservation, it will be necessary in many local boroughs to provide some means of insulating the same. It is envisaged therefore that with a method of construction in accordance with the present invention panels roughly the size of the cladding sheet can be provided which are themselves faced with a particle board or a coating but which includes affixed thereto an insulative polystyrene foam layer. This therefore can simply be adhered or otherwise fixed to the cladding sheet when that member is mounted in use.

The splicing members in accordance with the present invention are preferably formed from a steel, such as suitably treated mild steel, galvanised when climatic conditions necessitate it. The actual dimensions of the splicing plates is not critical but for a standard type building it is envisaged that the thickness of the splicing plate should be 10 mm. (All metal fittings should preferably be galvanised).

Ideally the splicing members should not be as wide as the timber plates so as to leave a gap for utilities.

A building in accordance with the present invention will be pre-cut ex-factory and prefabricated on site. A minimum of measurement on site is required. In fact with the preferred form of the present invention a simple template would be sufficient for measurement purposes. The size of the template obviously will depend on the size of modular structural cladding sheet as chosen, because obviously posts, beams etc, must be spaced by some fixed corresponding amount in relation thereto. Turning now to the drawings and for ease of explanation, referring to the same all at once when referring to any particular feature, it is to be noted that there are vertical posts 1 and inclined beams or rafter 2. In the case of the embodiment shown in FIGS. 2 and 3 there may also be flooring beams 3. Accordingly in conjunction with a structure as shown in FIGS. 2 and 3 there would be a rafter to wall post type splicing member 4, a wall post to flooring beam splicing member 5 and an anchoring splicing member 6.

Figure 8:
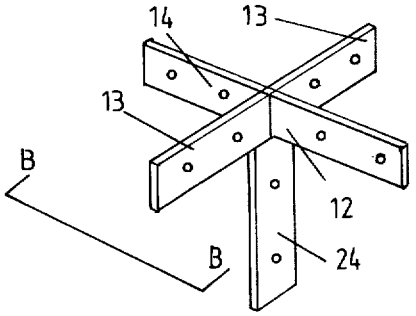
FIG. 8 is a view in perspective showing a prefabricated splicing member in accordance with the present invention capable of forming an apex between two butted and inclined rafter beams and also splicing thereto the ridge beam which is formed by spaced timber plate members and a column or post.
Figure 9:
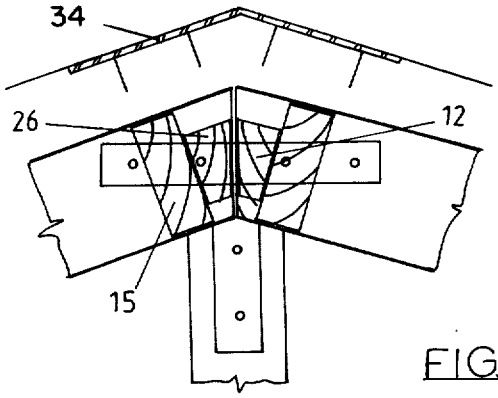
FIG. 9 is a view of such a member as shown in FIG. 8 taken from the angle B and showing the same holding a pair of inclined rafters together and showing in sectional form a spliced ridge member, the splicing member being shown in solid outline for ease of explanation.

The preferred anchoring member is designated by reference numeral 7 and is shown in FIG. 2 where it can be seen that by adopting a member which includes shaping a very favourable anchoring in concrete 8 or the like can be achieved while at the same time a portion of the splicing member 7 is nested snugly in between the spaced apart beams. A similar snug fitting also occurs with the splicing member 12 which is shown in FIGS. 3, 8 and 9. The form of this nesting is substantially as shown in FIG. 1 where there is splicing member 4, 5, 6, 12 etc., which can be of any type in accordance with the present invention which is dimensioned so as not to extend to either of the paired sides of the paired rafters 2 of the composite beams 3 or of the composite post 1.

This is so that a conduit or the like 11 can be nestled in between the composite members to carry utilities such as electrical wiring. It is highly desirable that such a gap for the utilities be provided on the inside of the building so that modifications etc. can be readily made. A person skilled in the art will appreciate how the same can be simply faced for aesthetics if deemed necesary.

The structure shown in FIG. 4 is one showing the framed type structures which can be assembled or mounted in accordance with the present invention. There can be seen a fabricated splicing member 12 which is best seen in FIGS. 8 and 11 as having a full length portion 13 and welded thereto extending wing members 14 which are to splice to the inclined beams 2 and a spaced pair of timber plates 15 which form a ridge for the structure (see FIG. 11). Obviously other members at right angles must extend between the frames shown in FIG. 4 and for this purpose reference should be made to FIG. 4 where such bracing members involved with the inclined beams or rafters 2 are shown. These purlins are designated by reference numerals 16. To those members and the rafter beams 2 is fixed the structural roof diaphragm which provides the bracing to the roof of the system designated 18R.

Figure 5:
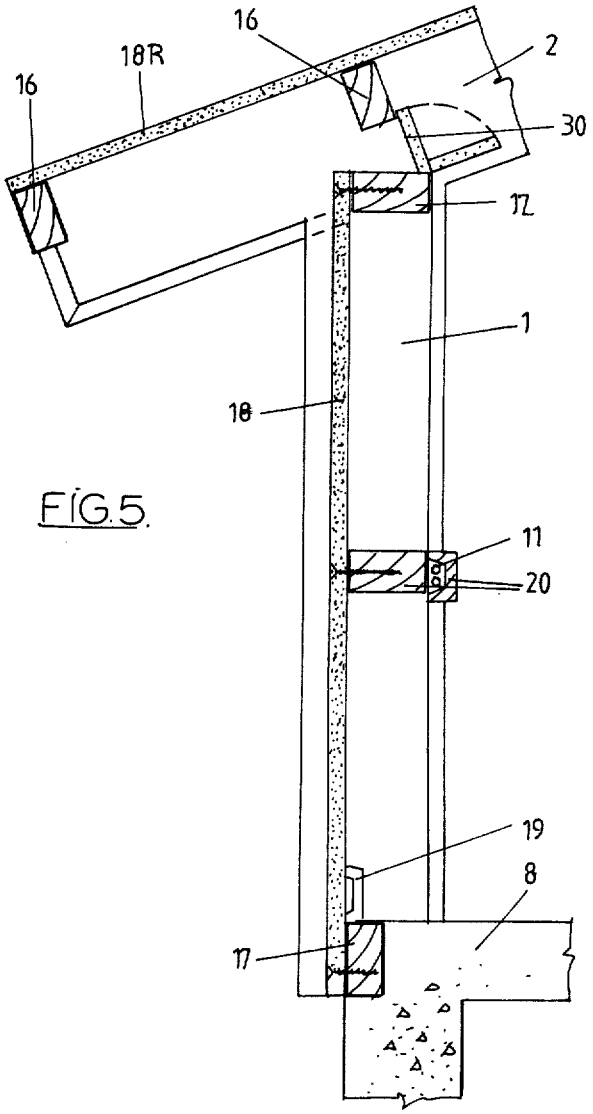
FIG. 5 is a sectionalised elevation view showing in cross-section a wall post and the cladding sheet of the present invention affixed thereto and showing also in relationship thereto an exterior holding batten and internally thereof nailing or bolting wooden plates to the bottom and of course the strong back which holds the sheet of material against any tendency to billow.

Also, shown in FIG. 5 are nailing or bolting plates 17 which can be appropriately anchored either to the concrete foundation 8 or primary timber members of the structure. These are necessary in order to anchor the horizontal peripheral regions of a rectangular structural sheet panel in accordance with the present invention. In the figures such a structural sheet is designated by the reference numeral 18. Shown in FIG. 5 is a skirting member 19 which can be fixed at any desired time if deemed necessary.

However, what is important is the strong back member 20 which is a member that spans between upright wall posts 1 and does not pass therethrough in order to weaken the structure. The term "strong back" in the present specification refers to a horizontal or substantially horizontally extending member that spans across the back of a structural sheet panel 18, in order to prevent the same being billowed under wind loads and the like. The strong back 20 does not constitute an essential structural member in order to support design weight loads on the structure. It is simply to ensure the stability of the panel 18. The wall panel 18 is the member that provides the bracing to the walls of the system.

Shown in FIGS. 5, 6, 7 and 10 is the manner in which sheet panels 18 are placed to form the composite structure.

Referring to FIG. 6 it can be seen that the composite posts 1 would have vertical peripheral portions of each sheet 18 placed thereover, and have the same fixed along its length to the internal plate members by screwing, nailing or stapling depending on local conditions and stresses generated. Overlying the vertical joint so as to make the joint both aesthetic and weatherproof and to further strengthen the peripheral anchoring of the panels, a batten or the like plate 21 is provided and this is bolted, nailed or screwed through as required to the composite column 1 thereby making a strong weight bearing structure. The batten 21 however, as can be seen in FIG. 4 is not an essential member to the structure, structurally, but is there basically covering the joint and for aesthetics. The batten can vary in dimension but should be of chosen thickness for stability.

Figure 10:
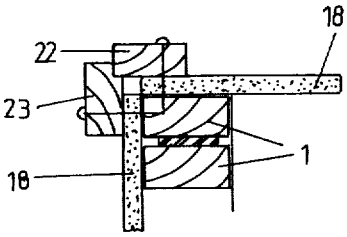
FIG. 10 is a plan view of a spaced corner column showing fixed thereto peripheral portions of cladding sheets in accordance with the present invention and a fabricated corner weathering batten pair.

FIG. 10 shows the choice of two different types of battens 22 and 23 in order to provide an aesthetic corner facing of a building in accordance with the present invention. However a person skilled in the art will appreciate what is clearly involved and other methods can be used.

FIG. 11 shows in perspective and in a simplified form the arrangement shown in FIGS. 8 and 9. It can be seen that the splicing member has one arm 24 thereto fixed by bolting or the like to an upright post 25. The upright post 25 is also paired as for posts 1 (it is shown in part). In as far as the spaced inclined beams or rafters 2 are concerned the overlying second member is also partially shown. FIG. 11 however shows the manner in which the angled spaced members of the ridge beams 15 are bolted through strapped blocks. It can be seen that packing members 26 are provided to provide a strong fit upon bolting. Also to strengthen the structure and especially in the case where inclined beams or rafters 2 are to be utilised in a form that is not supported by a column or post structure 25, a strap formed from a metal or the like can overlie the top of the line of abutment of the inclined beams and be fixed at varying distances down the length thereof. Such a strap could be for example, 2" to 3" wide depending of course on the structural size of the plates forming the inclined beams and such a strap is diagrammatically shown as 34 in exploded form spaced from the other members in FIG. 9.

FIG. 12 shows diagrammatically a post or column member, a bracing diaphragm cladding sheet 18 in a joinery framing member 27 of a window sash unit 28. It can be seen that the same is simply affixed, e.g. by nailing, to the outside of the structure. It can be seen also that the window sash is hinged 29 to the framing members 27 which simply hang down and over the framing member and hence there is no critical need to ensure that highly seasoned timbers etc. are utilised, owing to the fact that there is to be no receiving fit within the frame 27 but merely an overlapping fit. Also, in order to provide the best possible use of breezes, a ventilation opening is provided above the joinery unit. This is to allow the ingress or egress of air from the structure irrespective of whether or not the windows are open. Ideally however, some controlling flap 30 or the like is provided on the inside of the building. A person skilled in the art will appreciate how flap type openings which are flyproof in nature etc. have been provided in buildings which are securely locked for a long term. Such a system coupled with normal windows or the like should find widespread acceptance in the Tropical climates.

Turning to FIG. 13 there is shown diagrammatically the fact that where a wall is formed with a plurality of bays (i.e., spaces between adjacent wall posts) a structure erected in accordance with the present invention meets all structural requirements where at least two in every group of four bays is provided with two complete notional panels (i.e. where in conjunction with window joinery units and the like there is a half panel that half panel is a half notional panel), the summation of the half or complete notional panels should number two notional panels in every group of four bays. Individual buildings when required are engineer calculated to ensure stability.

From the foregoing then it can be seen that the present invention provides a strong low cost structure that would require for export a minimum of volume transit, minimum supervision and a minimum of knowhow on the part of the builders. It can also be seen that the cost of materials is reduced to a minimum and are simplified to be minimum in number (basically timber framing, structural diaphragm panels and metal straps).

It is envisaged that the frames could be erected and then the building clad. It may be appropriate however to prefabricate panels each with timber plate members at at least one periphery thereof and to assemble a wall or for that matter a roof by bolting in place such panels so that peripheral timber plate members of adjacent panels provide the paired timber plate framing members of a building in accordance with the present invention. A person skilled in the art will appreciate however, how size will have some bearing on whether or not such a system is practical. In use however it is envisaged that provided the dimensions are sufficiently small so as to be handled by for example, two men, such a system is certainly preferable for vertical walls and also is of some assistance where a crane is available in regard to roofing structures.

Ideally however, for a roof the timber framing members would be fitted in place prior to the cladding sheet being applied thereto.

It is envisaged that the roofing materials (in addition to the particle board) which are most suitable locally will be used, designed for the local conditions to ensure weatherproofing soundness with insulation if required.

Bolt numbers are shown diagrammatically for purposes of illustration only, but are in fact calculated in number depending on wind velocity and site conditions.

Where supporting posts are not desired similar type bolted splicing members shall be used with paired timber to form trusses.

All told, therefore, the structure in accordance with the present invention should find widespread use. Also the fact that a spaced beam structure is used preferably throughout means there is control of the occasional "rogue" timbers and therefore minimum wasteage.

What is claimed is:

1. A timber framed building which is prefabricated or fabricated in part prior to assembly, said building forming a post and beam structure on a foundation and being completed with diaphragm sheathing on the outside of the frame, wherein wall posts, rafters and ridge beam(s) of the frame and floor beams if the building is of more than one storey and ridge to floor intermediate posts, if any, each comprise a pair of timber plates in parallel spaced relationship which are connected (i) foundation to wall posts
(ii) wall posts to floor beams, if any
(iii) wall posts to rafters
(iv) rafters to ridge beam(s)
(v) ridge beam to post, if any
(vi) tie rafters and/or wall posts, if any, by metal splicing members secured between and to said spaced timber plates, and wherein said sheathing comprises a cladding of both exterior walls and roof with a waterproof, insect resistant, structural diaphragm formed from sheet material, a strong back member between said wall posts which runs substantially horizontally across the back of said cladding and is secured to said wall posts and is fixed along its length to the diaphragm sheet.

2. A building as claimed in claim 1 wherein said structure at selected points includes within its frame posts that extend from a ridge beam to the floor level or the foundation of the building.

3. A building as claimed in claim 2 wherein any such ridge post forms part of an internal partition.

4. A building as claimed in claim 2 wherein the metal splicing member that splices said ridge beam to such a ridge post also splices rafters that butt against said ridge beam.

5. A building as claimed in claim 1 wherein said diaphragm is formed from structural particle board or structural plywood.

6. A building as claimed in claim 1 wherein said building includes a plurality of purlins which extend at right angles to associated rafters.

7. A building as claimed in claim 6 wherein said purlins are butted into adjacent rafters, each said rafter being of paired timber plates.

8. A building as claimed in claim 7 wherein each said purlin is a single timber plate.

9. A building as claimed in claim 6 wherein said purlins have an upper edge flush with the upper edge of said rafters and have said load bearing diaphragm sheathing affixed.

10. A building as claimed in claim 1 wherein said sheathing is not rabbetted into any framing member.

11. A building as claimed in claim 1 wherein the building frame has a window beam between adjacent rafters above any window fitting between adjacent wall posts.

12. A building as claimed in claim 1 wherein any window fitting has the window frame fixed onto the outside surface of said diaphragm.

13. A building as claimed in claim 12 wherein above a window frame means is provided to allow ventilation of the building even when the window is in a closed condition.

14. A building as claimed in claim 1 wherein the fixing of the framing members to the metal splicing members is demountable.

15. A building as claimed in claim 1 wherein utilities selected from wiring and plumbing is passed under or behind the strong back member and is passed between paired timber plates of a framing member.

16. A building as claimed in claim 1 wherein the spacing apart of said pair of timber plates is about 10 mm.

17. A building as claimed in claim 1 wherein said ridge beam has the timber plates thereof spaced apart more at the upper edge than at the lower edges thereof, irrespective of whether or not the plates are spaced at the bottom edge thereof at all.

18. A method of building a prefabricated timber framed building from pre-cut timber, said building forming a post and beam structure on a foundation and being completed with diaphragm sheathing on the outside of the frame, wherein paired timber plates providing wall posts, rafters and ridge beam(s) of the frame and floor beams if the building is of more than one storey and ridge to floor intermediate posts, if any, are connected (i) foundation to wall posts
(ii) wall posts to floor beams, if any
(iii) wall posts to rafters
(iv) rafters to ridge beam(s)
(v) ridge beam to post, if any
(vi) tie rafters and/or wall posts, if any, by metal splicing members, and wherein said sheathing is a cladding of both exterior walls and roof with a waterproof, insect resistant, structural diaphragm formed from sheet material there being provided a strong back member between wall posts which runs substantially horizontally around the exterior walls and is secured to wall posts and is fixed along its length to the diaphragm sheet, said method including the steps of preparing a foundation, mounting thereon a frame for the building using paired timber plate for wall posts, rafters and ridge beams, and also for floor beams if the building is of more than one storey and, ridge to floor intermediate posts, if any, connecting the various framing members using metal splicing members and cladding the frame as it is being erected or after it is erected with a waterproof, insect resistant, load bearing, structural diaphragm formed from sheet material, and fixing substantially horizontally around the exterior walls between wall posts to which the same is secured, a strong back member and to the roof framing members a similar structural diaphragm material.

19. A method of erecting a building from pre-cut timber said building forming a post and beam structure on a foundation and being completed with diaphragm sheathing on the outside of the frame, wherein paired timber plates providing wall posts, rafters and ridge beam(s) of the frame and floor beams if the building is of more than one storey and ridge to floor intermediate posts, if any, are connected (i) foundation to wall posts
(ii) wall posts to floor beams, if any
(iii) wall posts to rafters
(iv) rafters to ridge beam(s)
(v) ridge beam to post, if any
(vi) tie rafters and/or wall posts, if any, by metal splicing members, and wherein said sheathing is a cladding of both exterior walls and roof with a waterproof, insect resistant, structural diaphragm formed from sheet material there being provided a strong back member between wall posts which runs substantially horizontally around the exterior walls and is secured to wall posts and is fixed along its length to the diaphragm sheet, which method includes the steps of assembling at least a plurality of prefabricated panels with a peripheral single plate framing member on at least one side thereof and bolting each timber plate to a frame member of another prefabricated panel with at least one peripheral single timber plate framing member and in so doing providing a said paired timber plate framing member of the building.

* * * * *